US005657900A

United States Patent [19]

Scherr

[11] Patent Number: 5,657,900

[45] Date of Patent: Aug. 19, 1997

[54] DISPENSER FOR PLASTIC BAGS

[75] Inventor: Donald Scherr, West End, N.J.

[73] Assignee: U.S. Plastics, Ltd., Long Beach, N.J.

[21] Appl. No.: 540,163

[22] Filed: Oct. 6, 1995

[51] Int. Cl.[6] ..... A47K 10/24

[52] U.S. Cl. ..... 221/45; 221/63

[58] Field of Search ..... 221/33, 45, 63; 206/554, 494, 225; 383/37

[56] References Cited

U.S. PATENT DOCUMENTS

| | | | |
|---|---|---|---|
| 3,161,336 | 12/1964 | Loescher | 206/494 |
| 4,216,863 | 8/1980 | Seymour-Smith | 206/554 |
| 5,269,423 | 12/1993 | Nguyen | 206/554 |

*Primary Examiner*—Kenneth Noland
*Attorney, Agent, or Firm*—Marvin Feldman

[57] ABSTRACT

A dispenser is formed of a flexible plastic pouch which has a removable flap providing an opening adjacent the bottom of the pouch, and a mounting or retaining element adjacent the top of the pouch. A plurality of stacked reclosable ended, opened, separate plastic bags are disposed in a folded stack within the pouch. The plastic bags are disposed adjacent the bottom of the pouch with the pouch mounted or retained. A portion of one outermost plastic bag reclosable end is disposed in the pouch opening, so that the user by the thumb and then the forefinger pulls the one plastic bag end portion causing the one plastic bag to slide over the adjacent plastic bag and through the opening. After removal of the one bag, the next adjacent bag is then similarly positioned for removal. The removed plastic bag is immediately ready for filling. The dispenser is particularly useful for dispensing reclosable plastic deli bags where the user's fingers are greasy. The dispenser of the present invention avoids undue manipulation to remove and eliminates the need to open the zippered plastic deli bag.

19 Claims, 3 Drawing Sheets

FIG. 1
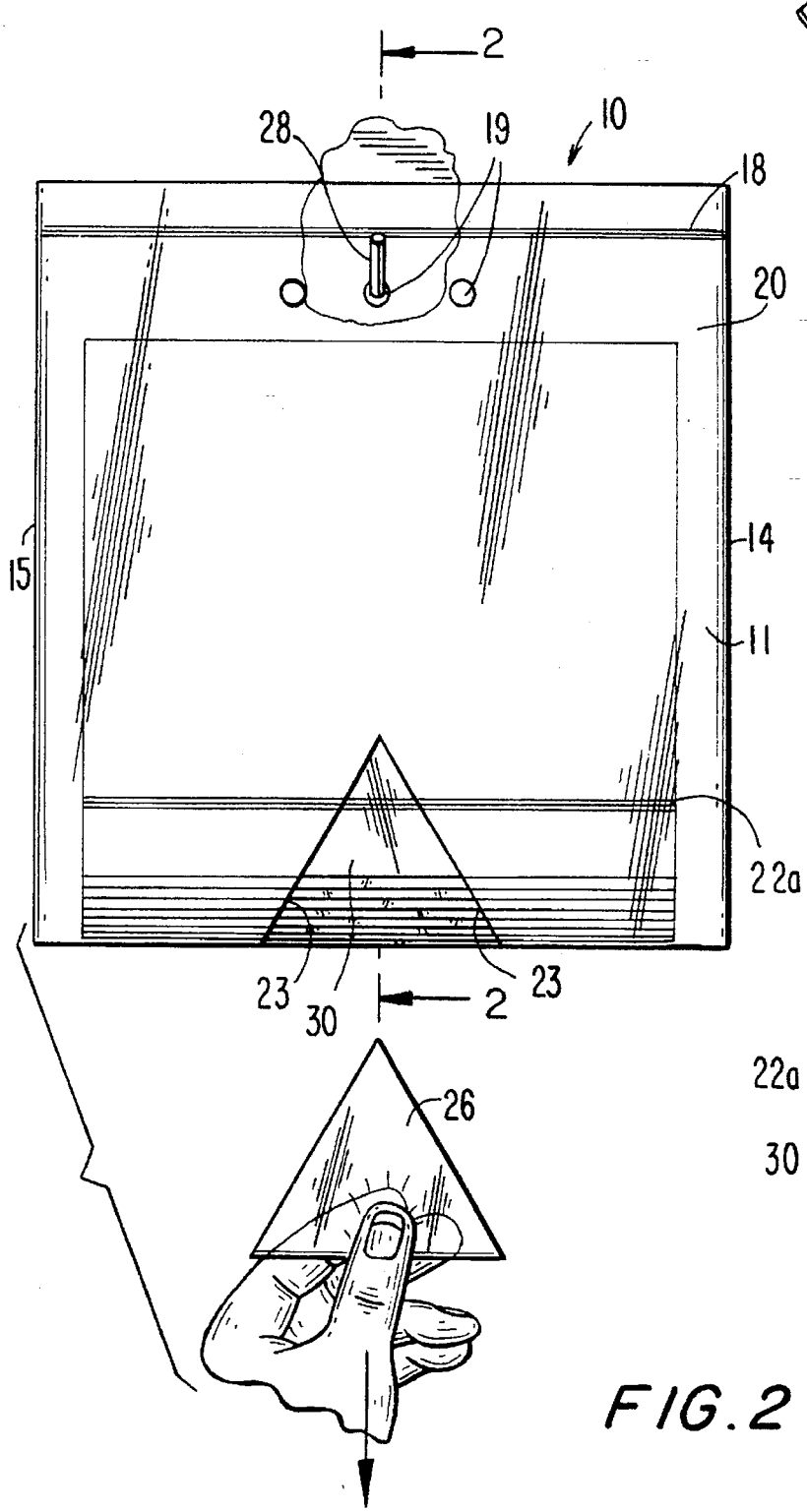
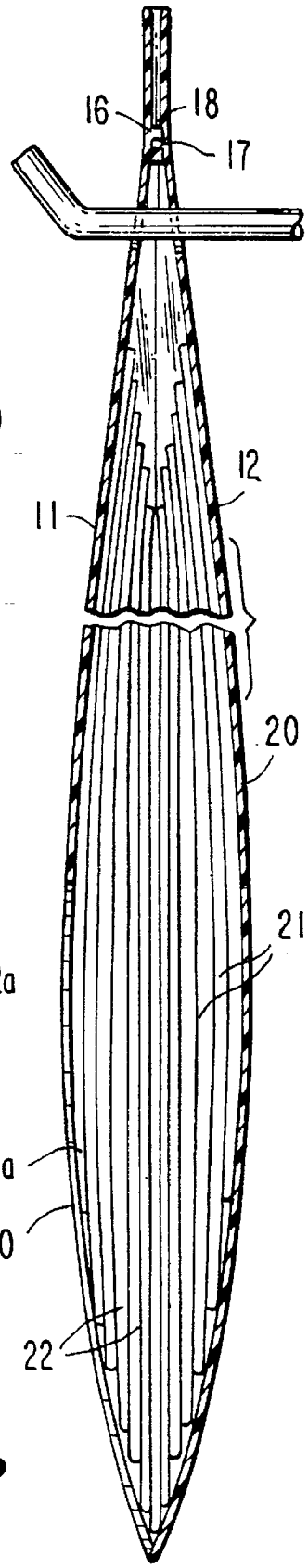
FIG. 2

FIG. 5
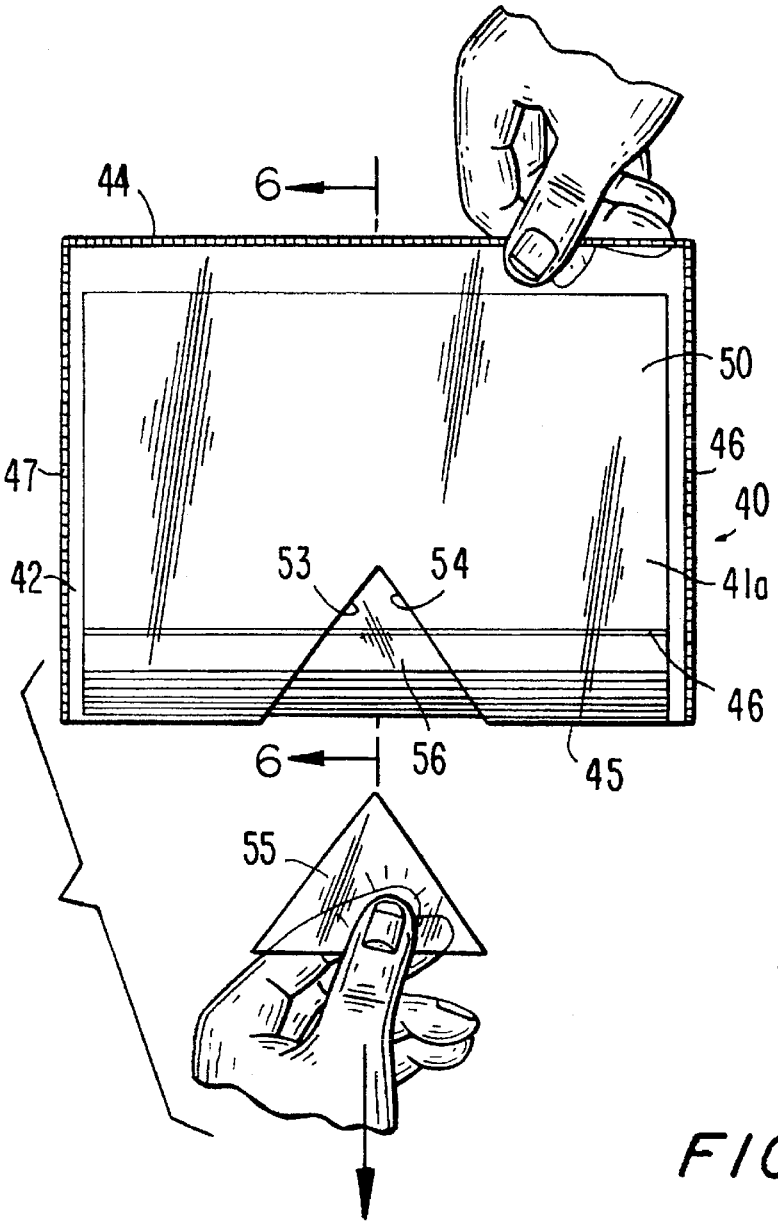
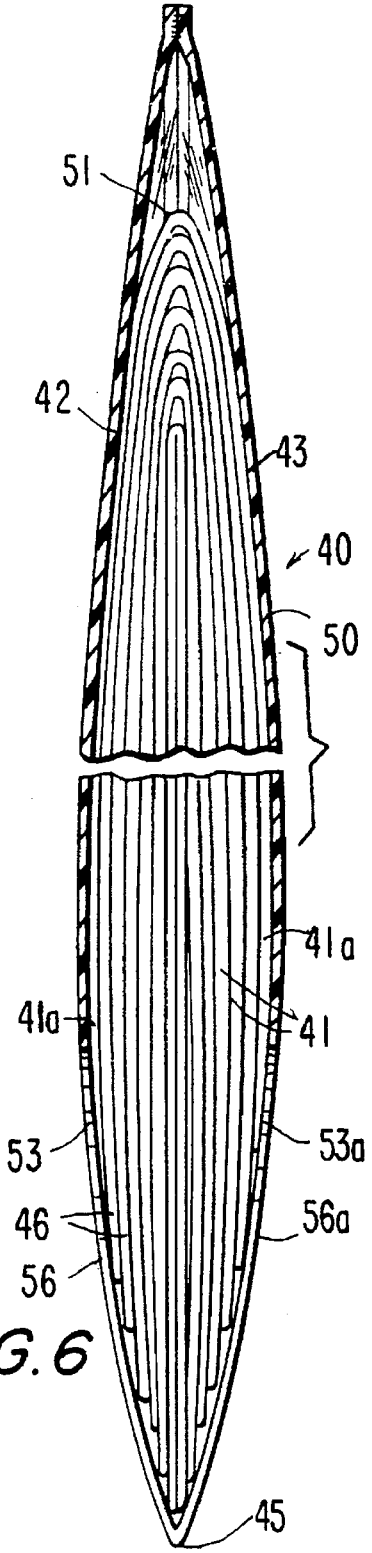
FIG. 6

DISPENSER FOR PLASTIC BAGS

BACKGROUND OF THE INVENTION

1. Field of the Invention

This invention relates to a dispenser for plastic bags.

2. Discussion of the Prior Art

Heretofore dispensers for plastic bags were generally constructed of rigid box-like containers wherein the plastic bags were separably inter-connected within the box. Such dispensers are disclosed in U.S. Pat. No. 4,712,684 to Boeckman, U.S. Pat. No. 4,805,800 to Nocek et al and U.S. Pat. No. 5,109,978 to Cawley. One attempt to make the plastic bags more readily removable from a box is disclosed in U.S. Pat. No. 4,512,276 to Herrington. In Herrington the plastic bags had to first be individually folded on parallel fold lines formed in each bag and then assembled and stacked within the box.

Another prior art approach was where there was no container, and instead the plastic bags were detachably attached on a header with the user having to pull and separate the bag from the header usually at a perforated line, and open the bag during or after removal. Such prior art constructions are disclosed in U.S. Pat. No. 3,221,927 to Lowry, U.S. Pat. No. 4,290,467 to Schmidt, U.S. Pat. No. 4,846,586 to Bruno, U.S. Pat. No. 5,255,883 to Greenfield et al, U.S. Pat. No. 5,309,698 to Huseman and U.S. Pat. No. 5,419,437 to Huseman.

These prior art constructions were not fully suitable for dispensing reclosable plastic deli bags. The art directed to dispensing reclosable plastic deli bags desired that, because of the greasy fingers of the user and the time constraints to rapidly fill the bags, the bags had to be removed with minimal manipulation and force and yet be immediately available for filling while avoiding the need to open the bag. The art also desired a readily manufactured and assembled low cost deli bag dispenser. The present invention achieves these prior art goals.

SUMMARY OF THE INVENTION

A dispenser is formed of flexible plastic panels or sheets joined or thermoplastically bonded at the edges to form a flexible plastic pouch having a removable flap adjacent the bottom of the pouch. In one embodiment, a mounting feature such as holes are formed adjacent and below the closed top end of the pouch. A plurality of separate reclosable plastic bags, such as deli bags, are in stacked disposition and sliding engagement within the pouch. The reclosable ends of the bags are open. The bags are in a stacked arrangement, and the pouch flexes to accommodate the stacked plastic bags. In use, the bags are disposed adjacent the bottom of the pouch. The stack of bags is preferably folded. The removable flap is preferably triangularly shaped and formed by perforations in one or both of the panels. When the flap is removed at the perforations, a triangularly shaped opening is provided, thereby providing access to the reclosable end of the outermost bag.

To remove a bag, a user, using the thumb and then the forefinger of one hand, pulls the outermost plastic bag reclosable end portion disposed in the opening downwardly so that the plastic bag slides over the adjacent plastic bag, and folds inwardly on itself in contactingly engaging the edges forming the triangular opening. After removal of the outermost bag, the reclosable end portion of the immediately adjacent bag is then disposed in the opening. The removed opened bag is immediately ready for filling and closure.

DESCRIPTION OF THE DRAWINGS

FIG. 1 is a front elevational assembly view of one embodiment of the dispenser of the present invention;

FIG. 2 is an enlarged partial fragmentary sectional view taken along line 2—2 of FIG. 1;

FIG. 5 is a front elevational assembly view of another embodiment of the present invention; and FIG. 6 is an enlarged partial fragmentary view taken along line 6—6 of FIG. 5.

DESCRIPTION OF THE PREFERRED EMBODIMENTS

Figure 3:
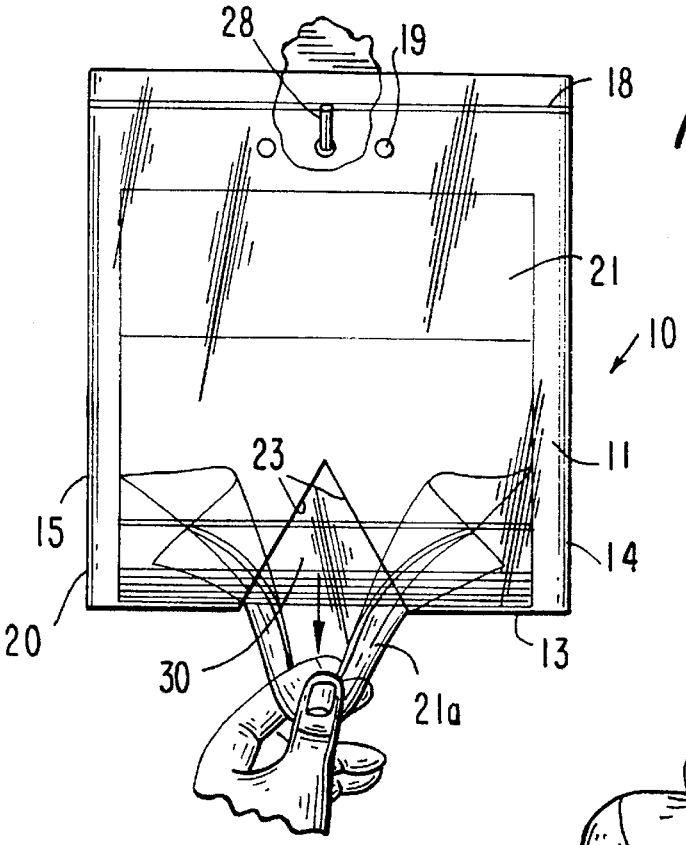
FIG. 3 is a reduced elevational view of the embodiment of FIG. 1, but showing the removal of a bag from the dispenser.

Referring to FIGS. 1–4, there is shown the dispenser 10 of one embodiment of the present invention. Dispenser 10 is formed of a flexible thermoplastic front panel or sheet 11 and a flexible thermoplastic back panel or sheet 12, which panels 11 and 12 are thermoplastically bonded at bottom edge 13 and side edges 14 and 15. A set of interlocking profiles 16 and 17 are formed on the respective top inside portions of panels 11 and 12 to provide a reclosable end seal or zipper 18, as is well known in the art. With zipper 18 closed, a closed flexible pouch 20 is provided for reasons hereinafter appearing. A plurality of three through holes 19 (typical) are formed in the panels 11 and 12, which holes 19 are disposed downwardly from zipper 18. The holes 19 permit mounting the pouch 20 on a fixedly mounted hook 28. The closed zipper 18 portion provides reinforcement at the top end of pouch 20 to prevent tearing of the pouch adjacent the holes 19 in using the dispenser.

A plurality of stacked bags 21 are disposed in pouch 20 between panels 11 and 12. The panels are flexed apart by the stack of bags, as best shown in FIG. 2. The plastic bags 21 are formed with reclosable zippers 22, as is well known in the art. The bags 21 are disposed so that the zippers 22 are adjacent the bottom edge 13 of the pouch 20. The bags 21 are in the open condition within pouch 20. That is, zippers 22 are unlocked with the bags enclosed within the pouch.

Front panel 11 is formed with a series of perforations 23 which form a triangular flap or piece 26. The zippers 22 or zippered portions of bags 21 are disposed behind flap 26. Pouch 20 is manufactured as a reclosable thermoplastic bag which is then provided with perforations 23 formed in panel 11, and holes 19 formed in panels 11 and 12, by plastic sheet cutting means well known in the art. Bags 21 are reclosable plastic bags of conventional construction. Bags 21 are unclosed when stacked within pouch 20, and pouch 20 is then sealed by and at zipper 18. The bags 21, while opened are nonetheless maintained in a contaminant-free environment within closed pouch 20, until the removal of flap 26 and use of dispenser 10.

Figure 4:
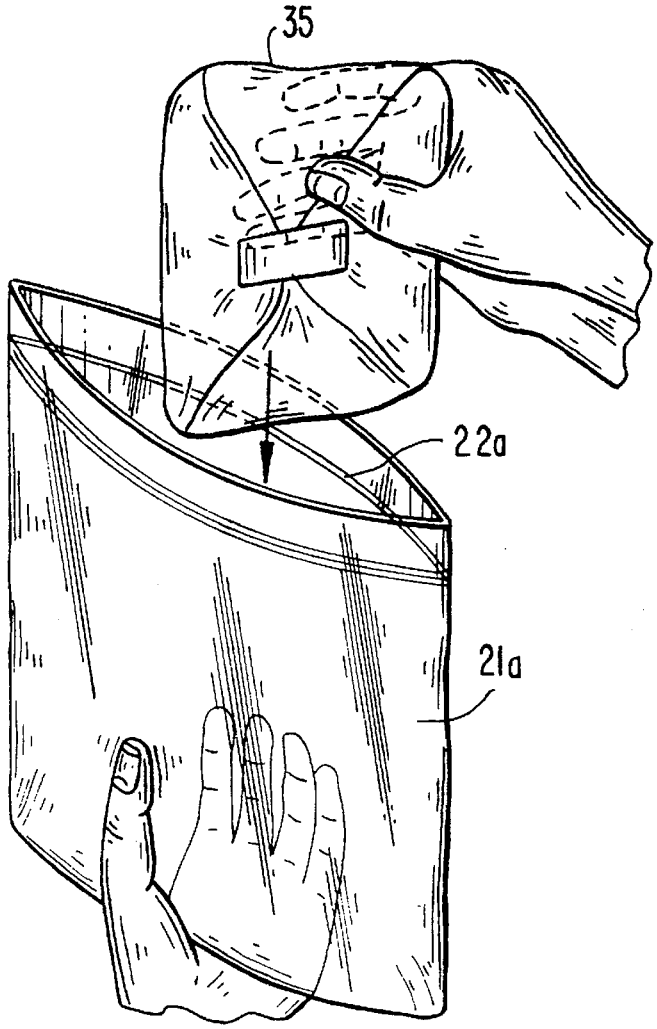
FIG. 4 is a perspective view showing the user filling the removed bag.

To use dispenser 10, the user first mounts pouch 20 on hook 28 by hole 19. The user then breaks perforations 23 and removes flap 26 (FIG. 1). With the removal of flap 26, the opened reclosable end **22*a* of the top or outermost bag 21*a* is disposed with the opening 30 formed by the removal of flap 26. The user using the thumb and then the forefinger pulls end 22*a* downwardly causing bag 21*a* to slide free of the immediately adjacent stacked bag. In removing bag 21*a*, bag 21*a* is caused to fold inwardly on itself by edges 29 forming opening 30, as best shown in FIG. 3. The removed bag 21***a* is immediately available to be filled. Referring specifically to FIG. 4, there is shown the filling of the pre-opened removed bag 21*a* with a freshly wrapped deli meat package 35.

It is to be noted that in use the stack of bags 21, may be prefolded or self-fold through gravity and with bag removal. The folded stack is however accommodated by the flexed apart panels 11 and 12. When folded, the bag stack assists in insuring that the reclosable end of the outermost bag is disposed within opening 30 for ready removal. That is, the folded stack of bags is a preferred embodiment, as further discussed in connection with the embodiment of FIGS. 5 and 6.

Referring to FIGS. 5 and 6, there is shown another embodiment of the present invention, dispenser 40. Dispenser 40 is designed primarily for the storage and removal of small reclosable bags 41, while dispenser 10 is better suited for large reclosable bags 21.

Dispenser 40 is formed of a front flexible thermoplastic sheet or panel 42 and a back flexible thermoplastic sheet or panel 43 which panels are sealed or thermoplastically bonded at top edge 44, bottom edge 45 and side edges 46 and 47 to form an enclosed flexible pouch 50. Bags 41 are stacked, and the stack of bags folded as at 51. Bags 41 are reclosable plastic bags having zippers or zipper closures 46 of conventional construction. With the stack of bags folded, the zipper closures 46 are disposed adjacent the bottom edge 45 of pouch 50.

A set of perforations 53 and 54 are formed on front panel 42, with a like contiguous set of perforations formed on back panel 43. (See FIG. 6 showing like back panel perforation 53*a*). In this manner of construction, a folded double triangular or quadrilateral flap or piece 55 is formed when the perforations are broken. With flap 55 removed, respective front and back triangular openings 56 and 56*a* are formed.

To use dispenser 40, the user holds top bonded edge 44 with the fingers of one hand to retain pouch 50, and with the other hand separates flap 55 from the pouch, as best shown in FIG. 5. The user then, while continuing to retain the pouch with one hand as shown in FIG. 5, using the thumb and forefinger of the other hand removes the outermost bag 41*a* from pouch 50 in a manner similar to that described in connection with the embodiment of FIGS. 1–4. Bag 41*a* slides over the immediately adjacent bag and is infolded upon itself (not shown) and is removed from pouch 50 through opening 56. The removed bag is ready to be filled. That is, bags 41 may be sealed within pouch 50 with bags 41 in the opened condition. The bags remain clean within the pouch until flap 55 is removed. While the flap is shown as being formed on the front panel in connection with the embodiment of FIGS. 1–4, a contiguous similar flap may be formed on the back panel, as shown in the preferred embodiment of FIGS. 5 and 6.

In a preferred embodiment, the pouch plastic sheet thickness is greater than the sheet thickness of the individual plastic bags. These relative sheet thicknesses provide the desired combination of flexibility and structural support. In a further preferred embodiment, the pouch sheet thickness is about 3.5 to 4.5 mils and preferably about 4.0 mils, and the plastic bag sheet thickness is about 1.5 to 3.0 mils.

The flap is preferably triangularly shaped with one side or edge of the triangular flap disposed adjacent and parallel to the bottom edge of the pouch. The length of then bottom edge of the flap opening extends about ⅓ of the length of the bottom edge of the pouch. The triangular shape is approximately equilateral. It is to be understood however that the dispenser may be sold with the flap removed, but it is most desirable to have the flap in place until just prior to use to insure that the deli bags are sealed within the pouch and remain clean and contaminant-free until use.

While the means for mounting the pouch is described as holes in the thermoplastic panels, other mounting means are within the contemplation of the invention. One such other mounting means, by way of example, is a reinforced thermobonded band disposed above or adjacent holes to support the pouch.

As is apparent from the foregoing description, there is provided by this invention a dispenser which permits a user with greasy fingers to readily remove a bag, such as a deli bag, with only minimal manipulation and force, and yet the removed bag is immediately available to be filled and closed, which dispenser is readily manufactured by inexpensive means of low cost thermoplastic sheeting, and which low cost dispenser, after depletion of the bags, is readily disposed of.

While the invention has been described in conjunction with preferred specific embodiments thereof, it will be understood that this description is intended to illustrate and not limit the scope of the invention, which is defined by the following claims.

What is claimed is:

1. A dispenser for plastic bags comprising; front panel means and back panel means having respective edges and means for joining the respective edges to form pouch means, one said panel means being formed with opening means, and a plurality of separate plastic bags in folded stacked disposition within said pouch means between said front and back panel means, one stacked plastic bag comprising an outermost bag, said outermost bag having first, second, and third potions, said first portion contactingly engages the front panel means and said second portion contactingly engages the back panel means, wherein the front and back panel means comprise flexible plastic sheet construction, and said front and back panel plastic sheets are flexed outwardly by said stacked plastic bags, with said third portion disposed at said opening means, whereby a user pulls the third portion through the opening means to remove the outermost plastic bag from the pouch means.

2. The dispenser of claim 1, said opening means comprising flap means formed by perforations in the front and back panel means, wherein with separation of the flap means at the perforations an opening is provided in the front and back panel means.

3. The dispenser of claim 1, further comprising another stacked plastic bag comprising an innermost plastic bag, said innermost plastic bag having first and second folded portions in contacting engagement, said innermost bag being the last removed bag from the pouch means.

4. The dispenser of claim 1, said third portion comprising a reclosable end portion.

5. A dispenser for plastic bags comprising; front panel means and back panel means having respective edges and means for joining the respective edges to form pouch means, one said panel means being formed with opening means, and a plurality of separate plastic bags in stacked disposition within said pouch means between said front and back panel means, with a portion of one plastic bag disposed at said opening means, wherein the front and back panel means comprise flexible plastic sheet construction, and said front and back panel plastic sheets are contactingly engaged by said one bag and flexed by said stacked plastic bags, each said plastic bag comprising plastic sheet construction, wherein the front and back panel means sheet thickness is greater than the plastic bag sheet thickness, whereby a user pulls the one plastic bag portion through the opening means to remove the one plastic bag from the pouch means.

6. The dispenser of claim 5, further comprising means for mounting said pouch means disposed adjacent said top edge.

7. The dispenser of claim 5, said flap means being triangularly shaped, and wherein one side of the triangular shape being disposed adjacent the bottom edge of the pouch means.

8. The dispenser of claim 5, each said plastic bag comprising plastic sheet construction, wherein the front and back panel means sheet thickness is greater than the plastic bag sheet thickness.

9. The dispenser of claim 8 each said plastic bag comprising a reclosable end portion, wherein the plastic bags are stacked so that the reclosable end portions are disposed adjacent the opening means, and said plastic bags being separate from each other and in sliding engagement, and wherein the plastic bags reclosable ends are in opened disposition within the pouch means, whereby the removed plastic bag is ready to be filled.

10. A dispenser for plastic bags comprising; first flexible panel means, second flexible panel means, and means for bonding said first and second panel means to form flexible pouch means, one said panel means being formed with opening means, a plurality of plastic bags having reclosable ends, said plastic bags being stacked and in sliding disposition inside said pouch means, and the reclosable end of the one plastic bag being disposed at the opening means, whereby a user pulls the one plastic bag reclosable end through the opening means in the one said panel means so the one plastic bag slides free of an adjacent stacked plastic bag to remove the one plastic bag from the pouch means, and with removal of the one plastic bag the adjacent plastic bag reclosable end is then disposed at the opening means.

11. The dispenser of claim 10, said opening means being disposed adjacent an end of the pouch means, and means for holding the pouch means in place disposed adjacent an opposite end of the pouch means.

12. The dispenser of claim 11, said reclosable bags being in open disposition within the pouch means.

13. The dispenser of claim 10, said opening means comprising flap means formed in said one panel means, and means for removing the flap means from the said panel means for forming an opening in said one panel means.

14. The dispenser of claim 13, said pouch means and said plastic bags comprise thermoplastic sheet construction.

15. The dispenser of claim 14, said flap means comprises a thermoplastic piece formed by perforations in said one panel means, whereby the user separates the flap means at the perforations to remove the flap means to form the opening means.

16. The dispenser of claim 14, and wherein the pouch means sheet thickness is about 3.5 to 4.0 mils and the plastic bag sheet thickness is about 1.5 to 3.0 mils.

17. The dispenser of claim 10, said pouch means comprising flexible plastic sheet construction that contactingly flexibly engages the stacked plastic bags disposed between the first and second panel means.

18. The dispenser of claim 17, said opening means being disposed adjacent an end of the pouch means, and means for holding the pouch means in place disposed adjacent an opposite end of the pouch means, whereby with the pouch means supported by the holding means the plastic bags are disposed at the said opposite end of the pouch means, and said opening means being disposed at the said opposite end of the pouch means.

19. The dispenser of claim 10, said stacked plastic bags being in folded disposition within the pouch means, wherein the said one bag is folded so that one folded portion of the one bag is more adjacent the first panel means than the other plastic bags and another folded portion of the one bag is more adjacent the second panel means than the other plastic bags.

* * * * *